US012553696B1

(12) United States Patent
Conklin

(10) Patent No.: US 12,553,696 B1
(45) Date of Patent: Feb. 17, 2026

(54) INTERLOCKING EXPANDABLE AIR-DROP PACKAGE

(71) Applicant: Jesse Hunter Conklin, Partlow, VA (US)

(72) Inventor: Jesse Hunter Conklin, Partlow, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 19/041,653

(22) Filed: Jan. 30, 2025

(51) Int. Cl.

| | |
|---|---|
| ***F42B 25/00*** | (2006.01) |
| ***F42B 8/22*** | (2006.01) |
| ***F42B 10/06*** | (2006.01) |
| ***F42B 12/58*** | (2006.01) |
| ***F42B 30/00*** | (2006.01) |

(52) U.S. Cl.
CPC ..... *F42B 25/00* (2013.01); *F42B 8/22* (2013.01); *F42B 10/06* (2013.01); *F42B 12/58* (2013.01); *F42B 30/003* (2013.01)

(58) Field of Classification Search
CPC .. F42B 8/22; F42B 10/06; F42B 12/58; F42B 30/003; F42B 25/00; B65D 39/10; B65D 21/086
USPC ..... 220/293, 296, 298
See application file for complete search history.

(56) References Cited

U.S. PATENT DOCUMENTS

| | | | | | |
|---|---|---|---|---|---|
| 876,630 | A * | 1/1908 | Gaynor | F42B 3/24 | 220/296 |
| 2,408,246 | A * | 9/1946 | Walter | B64D 1/02 | 229/5.5 |
| 2,454,616 | A * | 11/1948 | Schultz | B64D 1/02 | 206/583 |
| 2,501,559 | A * | 3/1950 | Winzen | B64D 1/02 | 244/150 |
| 3,016,216 | A * | 1/1962 | King | B64D 1/02 | 244/140 |
| 3,221,656 | A * | 12/1965 | Sutten | F42B 8/24 | 244/138 R |
| 3,391,885 | A * | 7/1968 | Genco | B64D 1/02 | 188/371 |

(Continued)

FOREIGN PATENT DOCUMENTS

| | | | | |
|---|---|---|---|---|
| CN | 106225608 A | * | 12/2016 | F42B 39/00 |
| DE | 102005023908 A1 | * | 11/2006 | F42B 12/54 |

(Continued)

*Primary Examiner* — Gabriel J. Klein
(74) *Attorney, Agent, or Firm* — Gerhard W. Thielman

(57) ABSTRACT

A modular air-drop package assembly is provided for delivering an internal payload. The assembly is oriented along axial, radial and angular directions, and includes a front section and a rear section. The front section has a hollow housing open at its rear along the axial direction. The housing has an inner wall that includes a plurality of angularly spaced indentations. Each indentation extends radially into the wall. The rear section has a bulkhead, a sleeve and a corresponding plurality of flanges. The bulkhead closes the housing at the rear. The sleeve extends axially forward from the bulkhead along the axial direction for insertion into the housing. The plurality of flanges extends forward from the bulkhead. Each flange has a radially extending tab that engages with a corresponding indentation of the plurality.

19 Claims, 7 Drawing Sheets

(56) References Cited

U.S. PATENT DOCUMENTS

| | | | | | |
|---|---|---|---|---|---|
| 3,414,218 | A * | 12/1968 | Russnak | B64D 1/02 | 102/385 |
| 4,360,117 | A * | 11/1982 | Tardot | B63B 22/003 | 220/4.01 |
| 4,509,656 | A * | 4/1985 | Rosler | B65D 21/086 | 220/8 |
| 4,771,696 | A * | 9/1988 | Smolnik | F42B 30/003 | 102/293 |
| 5,235,930 | A * | 8/1993 | Pendleton | B63B 3/08 | 114/330 |
| 5,562,212 | A * | 10/1996 | Rosler | B25H 3/003 | 220/8 |
| 10,569,938 | B2 * | 2/2020 | Zhao | B65D 45/16 | |
| 11,465,745 | B1 * | 10/2022 | Klaftenegger | B65D 81/02 | |
| 2008/0314903 | A1 * | 12/2008 | Ohlson | F42B 39/14 | 220/316 |
| 2010/0126740 | A1 * | 5/2010 | Hartmann | F42B 12/50 | 169/36 |
| 2013/0334220 | A1 * | 12/2013 | Sohler | B65D 21/086 | 220/4.03 |
| 2019/0152649 | A1 * | 5/2019 | Hadar | B65D 85/20 | |
| 2020/0041244 | A1 * | 2/2020 | Ohlson | F42B 33/06 | |
| 2021/0147114 | A1 * | 5/2021 | Nyul | B65D 85/20 | |
| 2024/0010335 | A1 * | 1/2024 | Thornhill | F42C 5/00 | |
| 2025/0019078 | A1 * | 1/2025 | Hollifield | B64D 1/12 | |

FOREIGN PATENT DOCUMENTS

| | | | | |
|---|---|---|---|---|
| FR | 2811073 | A1 * | 1/2002 | F42B 5/18 |
| GB | 191503217 | A * | 8/1915 | F42C 1/09 |
| WO | WO-03095931 | A2 * | 11/2003 | F42B 39/20 |

* cited by examiner

INTERLOCKING EXPANDABLE AIR-DROP PACKAGE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to munition packages. In particular, the invention relates to modular air-drop packages to incorporate various payloads.

Existing air-drop munition packages generally comprise fixed designs with predetermined payload capacities. These systems often rely on mechanical fasteners, adhesives or external hardware to secure payloads. Such fastening techniques can be cumbersome, labor-intensive, and prone to mechanical failure. Conventional techniques also limit adaptability and increase production costs due to the necessity of additional hardware.

SUMMARY

Conventional air-drop packages yield disadvantages addressed by various exemplary embodiments of the present invention. In particular, various exemplary embodiments provide an air-drop modular package assembly for delivering an internal payload. The assembly is oriented along axial, radial and angular directions, and includes a front section and a rear section.

In various embodiments, the front section has a hollow housing open at its rear along the axial direction. The housing has an inner wall that includes a plurality of angularly spaced indentations. Each indentation extends radially into the wall. The rear section has a bulkhead, a sleeve and a corresponding plurality of flanges. The bulkhead closes the housing at the rear. The sleeve extends axially forward from the bulkhead along the axial direction for insertion into the housing. The plurality of flanges extends forward from the bulkhead. Each flange has a radially extending tab that engages with a corresponding indentation of the plurality.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims. For reference, the disclosure generally employs quantity units with the following abbreviations: length in meters (m) or inches (") and mass in grams (g) or pounds-mass ($lb_m$).

The objective of this disclosure is to describe a modular package designed for volumetric expansion. Exemplary embodiments provide a modular package concept featuring an expandable internal payload capacity. Such increase in payload can denote instrumentation, explosive, ballast or other intended material. The embodiments employ components composed of injected resin for casting or materials produced by additive manufacturing, i.e., three-dimensional (3D) printing. Such designs facilitate secure attachment and detachment of payloads without the need for additional fastener hardware or adhesives. This design streamlines the process of configuring packages and enhances operational versatility.

Figure 1A:
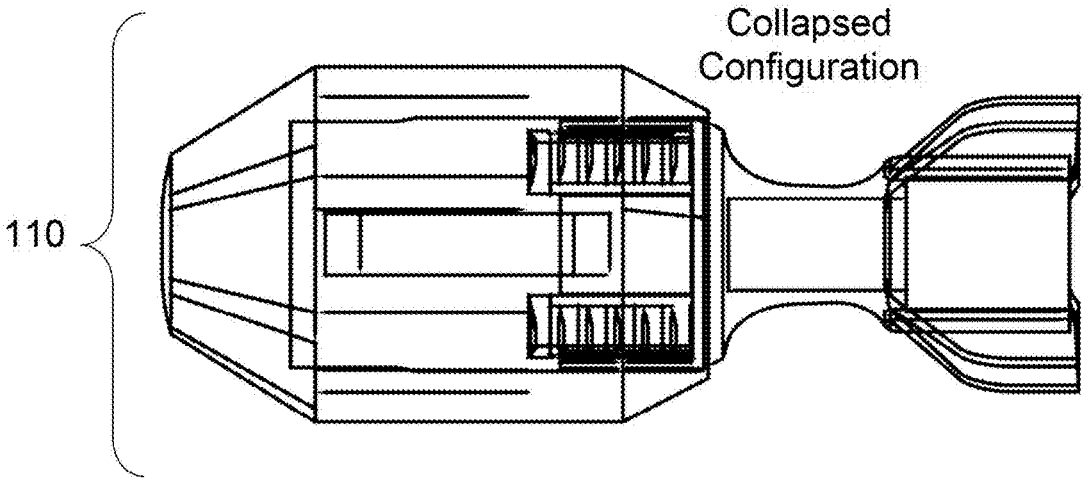
FIGS. 1A and 1B are elevation views of an exemplary modular air-drop package assembly.
Figure 1B:
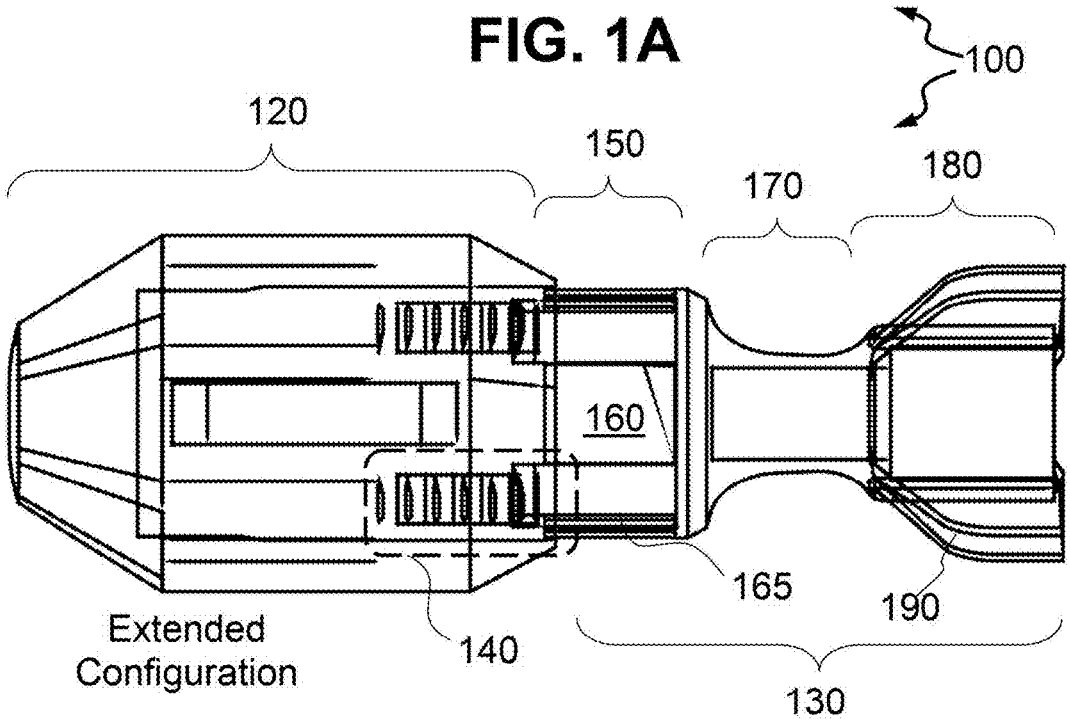

FIGS. 1A and 1B show elevation cross-sectional views 100 of an exemplary modular package assembly 110. FIG. 1A shows the substantially axi-symmetric assembly 110 in contracted or collapsed configuration, while FIG. 1B shows the assembly 110 in expanded or extended configuration. The assembly 110 comprises a front section 120 and a rear section 130. Note that front and rear relationships represent orientation with respect to loading the assembly 110 for ejection from a platform dispenser, such as release from an aerial drone or aircraft. Also, the axi-symmetric geometry is exemplary and not limiting.

The front section 120 includes a series 140 of angularly and axially spaced indentions. The rear section 130 includes an internal insert 150 that includes an annular sleeve 160 flanked by an angularly distributed set of flanges 165, a mezzanine neck 170 and an tail section 180 with stabilizing fins 190 attached thereto. The flanges 165 curve around the axial direction. The fins 190 provide aerodynamic stability for the package 110 after aerial drop from its elevated delivery platform without spin while oriented with the axial direction downward towards ground level.

The front and rear sections 120 and 130 can be separate unitary compositions via additive manufacturing. Their material can comprise lightweight polymers, or alternatively from select metal alloys for greater structural integrity. Plastics used for 3D printing include acrylonitrile butadiene styrene (ABS), polyethylene terephthalate, nylon, and polystyrene, with ABS having been used to construct a prototype. Artisans of ordinary skill will note that such designs can be employed for gun-launch systems, provided material composition has requisite strength and temperature resistance.

The prototype package 110 composed of ABS and designed for drone air-drop has dimensions of a height (or length) approximately 6" (although this can vary as explained herein), with a diameter of about 3.5" and a mass of about 0.5 $lb_m$ empty. The package 110 has been tested with an approximate payload mass of 0.5 $lb_m$ for a combined mass of about 1 $lb_m$ empty, although evaluation suggests higher masses would be practical.

Figure 2A:
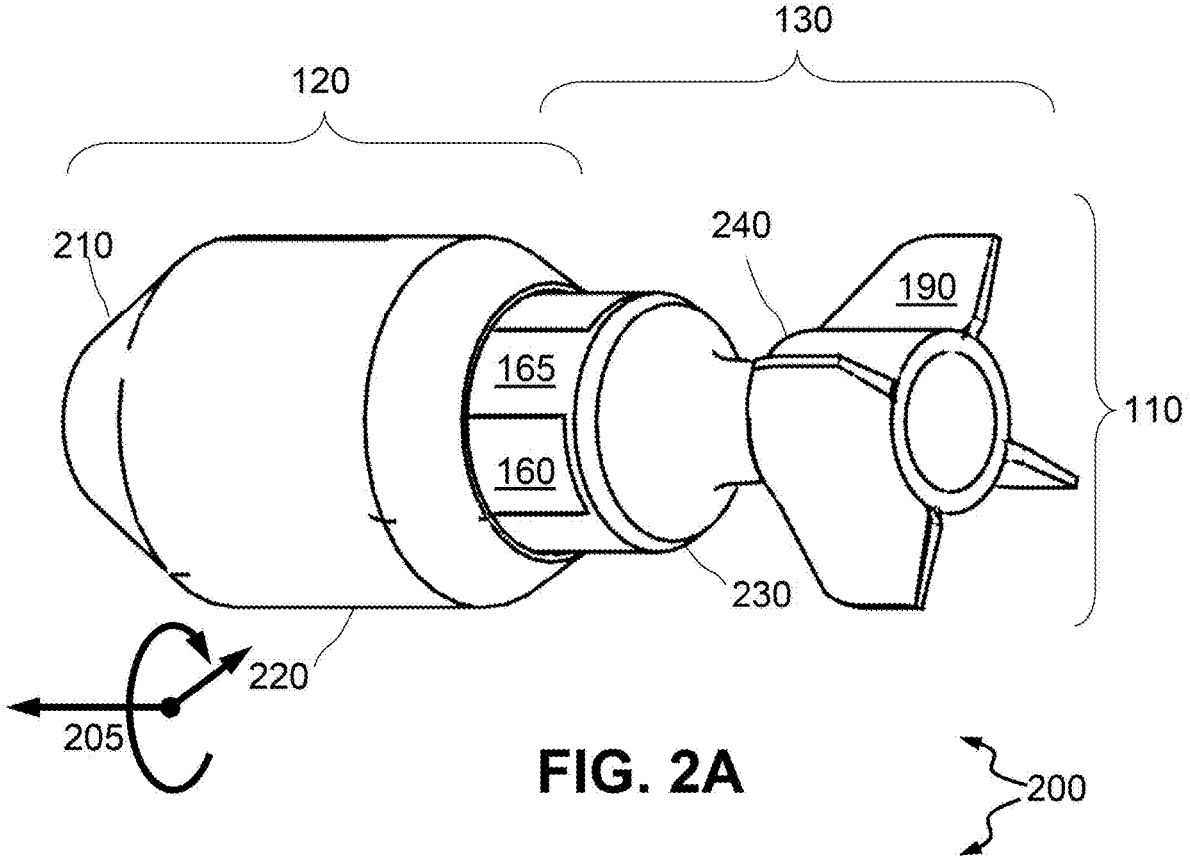
FIGS. 2A and 2B are isometric views of the assembly.
Figure 2B:
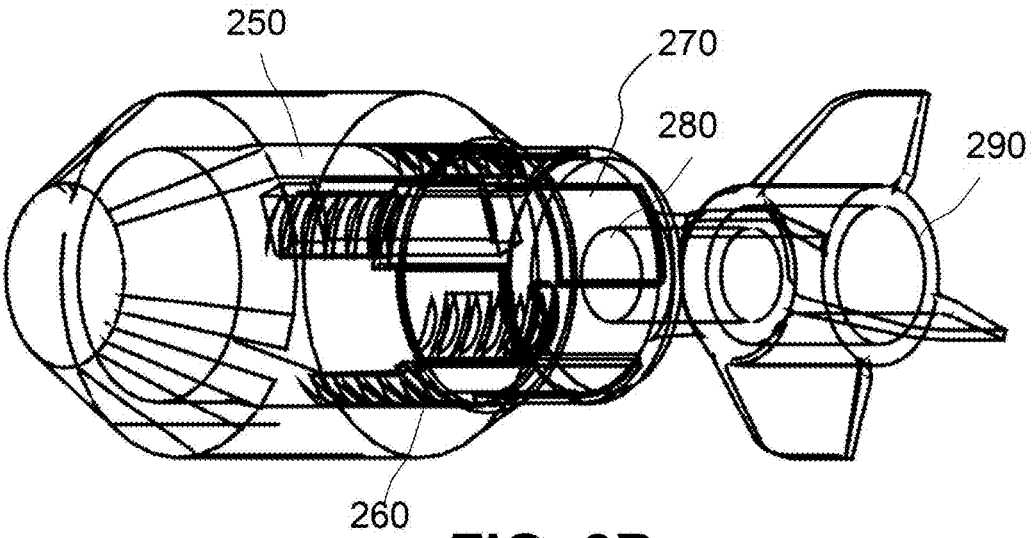

FIGS. 2A and 2B show isometric views 200 of the exemplary assembly 110 in the expanded configuration with a compass rose 205 for geometric reference, showing the axial forward, radial and azimuthal anti-clockwise roll directions (as viewable from the rear). FIG. 2A shows the assembly 110 as opaque, while FIG. 2B shows the assembly 110 as transparent.

The front section 120 constitutes a hollow housing that includes a conical frustum nose 210 and an annular fore-body tube 220 open at the rear. The annular sleeve 160 and flanking flanges 165 attach to a bulkhead shoulder 230 of the fore end of the neck 170. An annular aft-body 240 extends axially behind the neck 170 for attaching the fins 190. For air-drop delivery, the axial direction points downward, and 3D printing can be implemented by such axial orientation.

The tube 220, closed at the front by the nose 210, defines a primary cylindrical chamber 250 that operates as the enveloped payload volume, which for the prototype would be about twenty cubic inches. Example payloads for the chamber 250 include explosives, first-aid supplies or other portable high-value items. The set 140 of axially distributed indentations 260 are inscribed radially outward and extend angularly, on inner walls of the tube 220. The sleeve 160 defines an auxiliary cylindrical chamber 270 that extends the payload volume as needed. The shoulder 230 serves to close the payload volume with chambers 250 and 270. The set 140 can be extended farther forward in the tube 220 to enable the insert 150 to collapse the internal volume further to enable smaller form factor for storage. The neck 170 defines a separate narrow cylindrical cavity 280 that leads to a wide cylindrical cavity 290 within the aft-body 240. The cavity 290 can be open to the rear as illustrated.

The configuration illustrated features an array of four (4) fins 190 in cruciform pattern angularly distributed around the aft-body 240, as well as four (4) flanges 165 extending forward from the shoulder 230 that correspond to four (4) sets 140 of indentations 260. These plural integers are merely exemplary and not limiting.

Figure 3A:
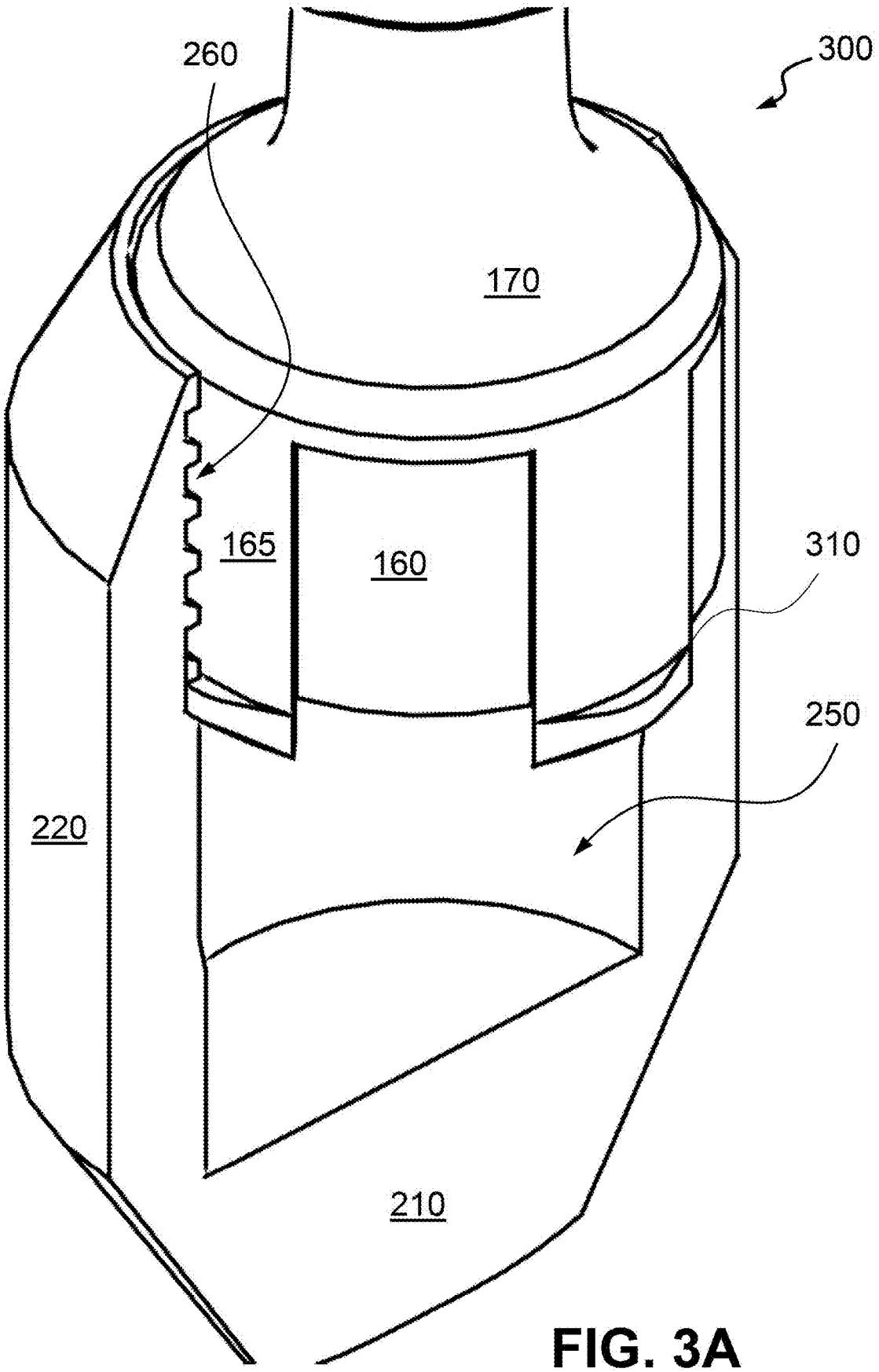
FIGS. 3A and 3B are isometric cross-section views of the assembly.
Figure 3B:
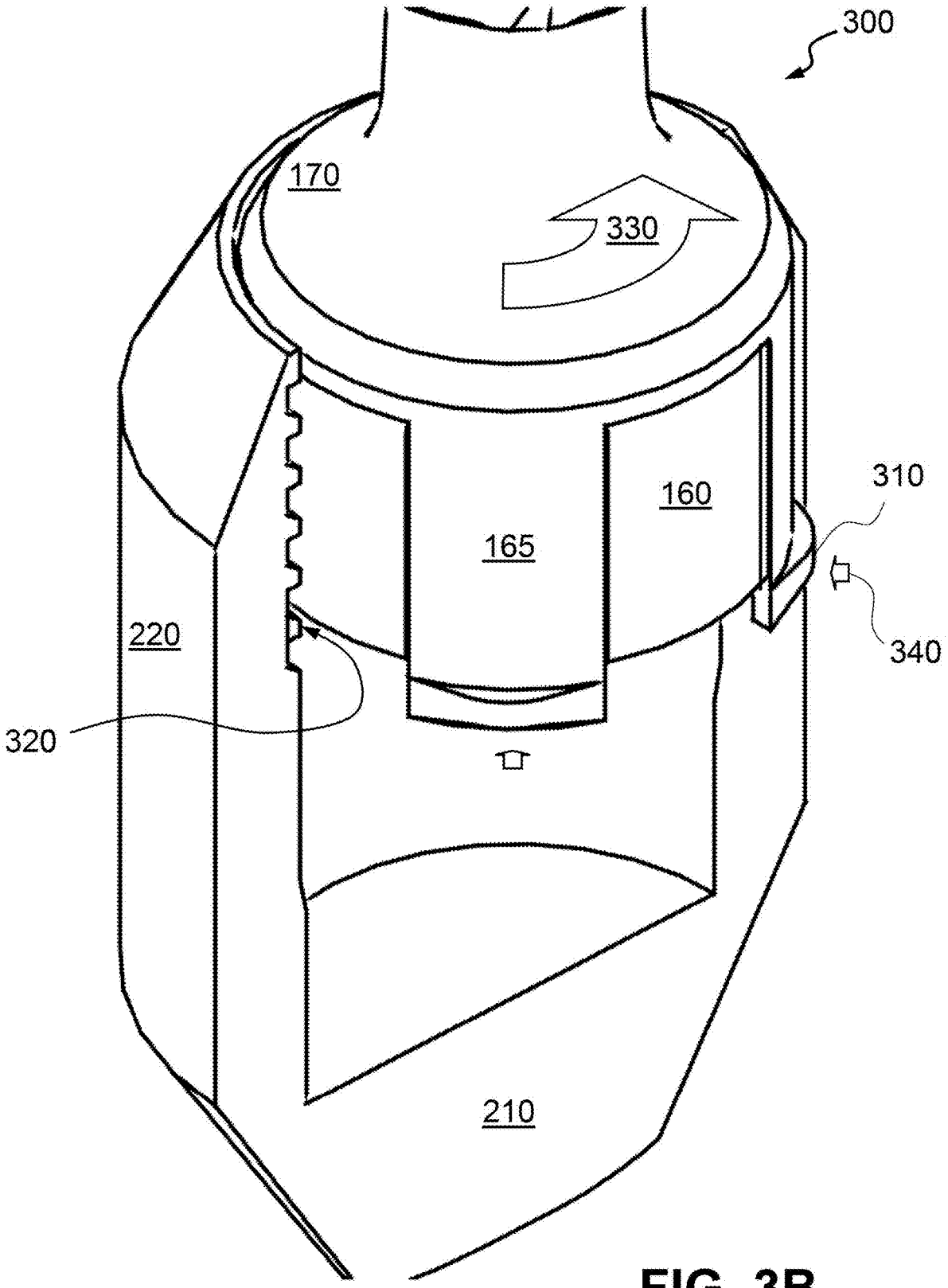

FIGS. 3A and 3B show isometric cutaway views 300 of the exemplary assembly 110 in the contracted configuration. Note that the front section 120 is displayed half removed as cut along the axial centerline, while the rear section 130 remains complete. FIG. 3A shows the front and rear sections 120 and 130 in their compact or collapsed configuration, thereby exhibiting the primary cylindrical volume 250 disposed between nose 210 and neck 170.

Each flange 165 terminates with a beveled cam or tab 310 that extends radially and engages corresponding indentations 260. The tab 310 arcs radially outward from the flange 165 gradually extending along its angular extent from no protrusion at the edges to its peak protrusion midway between the sides. The tab's bevel has an axial chamfer at its forward tip to facilitate insertion into an indentation 260, whereas the aft terminus features a ratchet step to inhibit axially rearward travel while engaged with a corresponding indentation 260.

As shown for the collapsed configuration, the tabs 310 engage with the fore-most indentations 260 of the sets 140. Note that the set 140 forms a corresponding array of radially inward teeth 320 (axially adjacent to their indentations 260). FIG. 3B shows the rear section 130 twisting in roll a quarter turn clockwise 330 (as viewed axially forward) that disengages the tabs 310 from their indentations 160 and flexes the flanges 165 radially inward 340 along the inner wall of the tube 220. Note that twisting anti-clockwise in roll by left-handed operators achieves the same result. Also, the quarter turn is exemplary for the design of four flanges 165 corresponding to four sets 140 as couples and may be lesser or greater in angular rotation for more or fewer such couples. This twist enables the insert 150 to be pulled out from the tube 220.

Figures 4A, 4B, 4C:
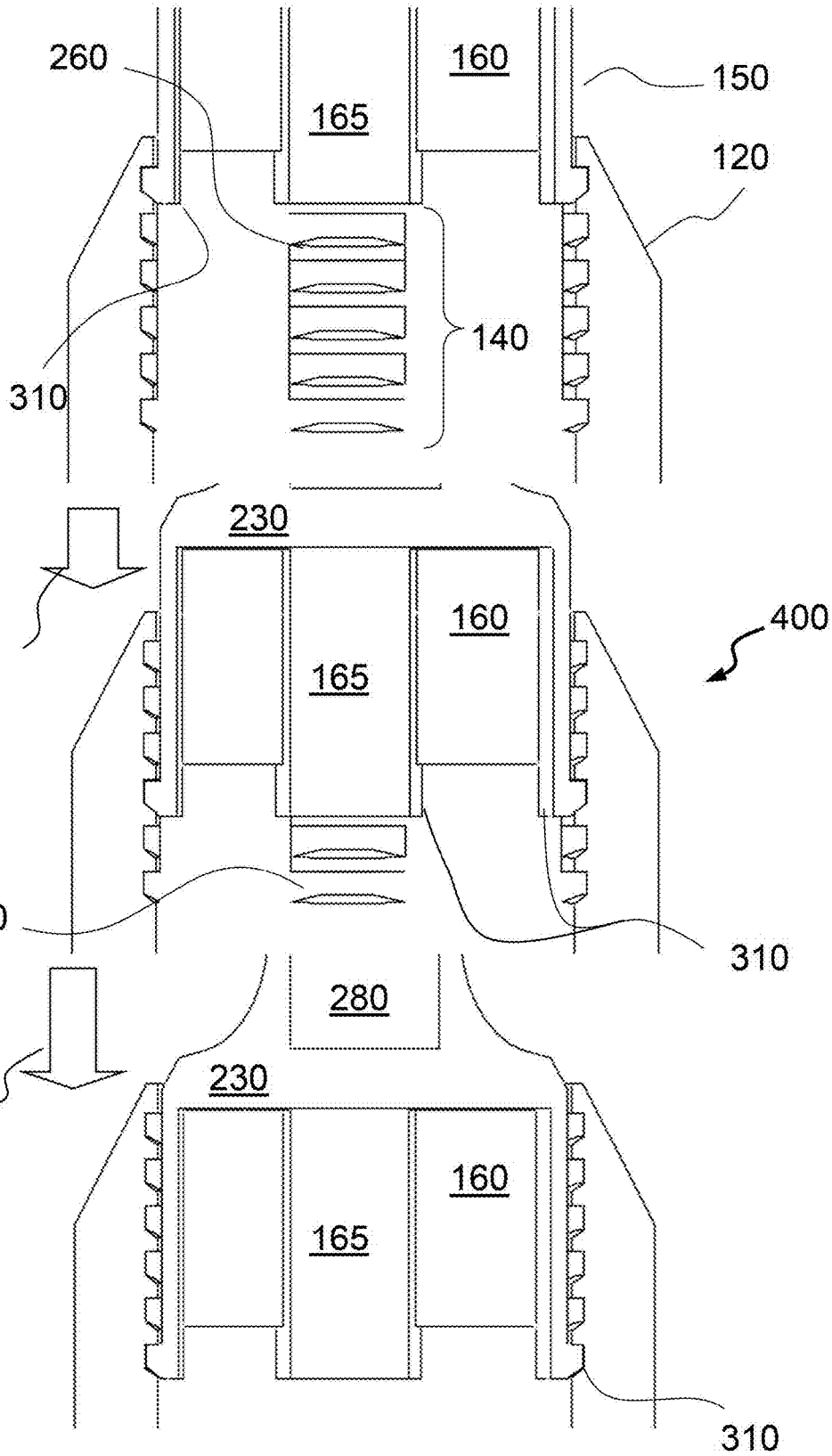
FIGS. 4A, 4B and 4C are elevation cross-section detail views of the assembly.

FIGS. 4A, 4B and 4C show isometric cross-sectional views 400 of the exemplary assembly 110 exhibiting sequential expansion from extended configuration in FIG. 4A to collapsed configuration in FIG. 4C. In the former, the tabs 310 on the flanges 165 engage the most rearward indentation 260 of the set 140 for maximizing the volume of the auxiliary chamber 270. In the latter, the tabs 310 engage the most forward indentation 260 of the set 140 for limiting the internal payload volume to only the primary chamber 250. Forward of the cavity 270, the shoulder 230 supports the sleeve 160 and the flanges 165.

Pushing the rear section 130 into the front section 120 induces axial motion forward 410 as shown in FIG. 4B, and continued pushing increases this motion 420 in FIG. 4C. Note that from the extended configuration, this travel reduces the internal payload volume to ensure payload fits snugly in the chambers 250 and 270. As the flanges 165 travel forward, the tabs 310 slip into their corresponding sets 140 of indentations 260, facilitated by chamfered forward edges, while the radial ratchet at their rear edges inhibits back sliding. Further pushing causes additional travel forward into more indentations 260.

Figure 5A:
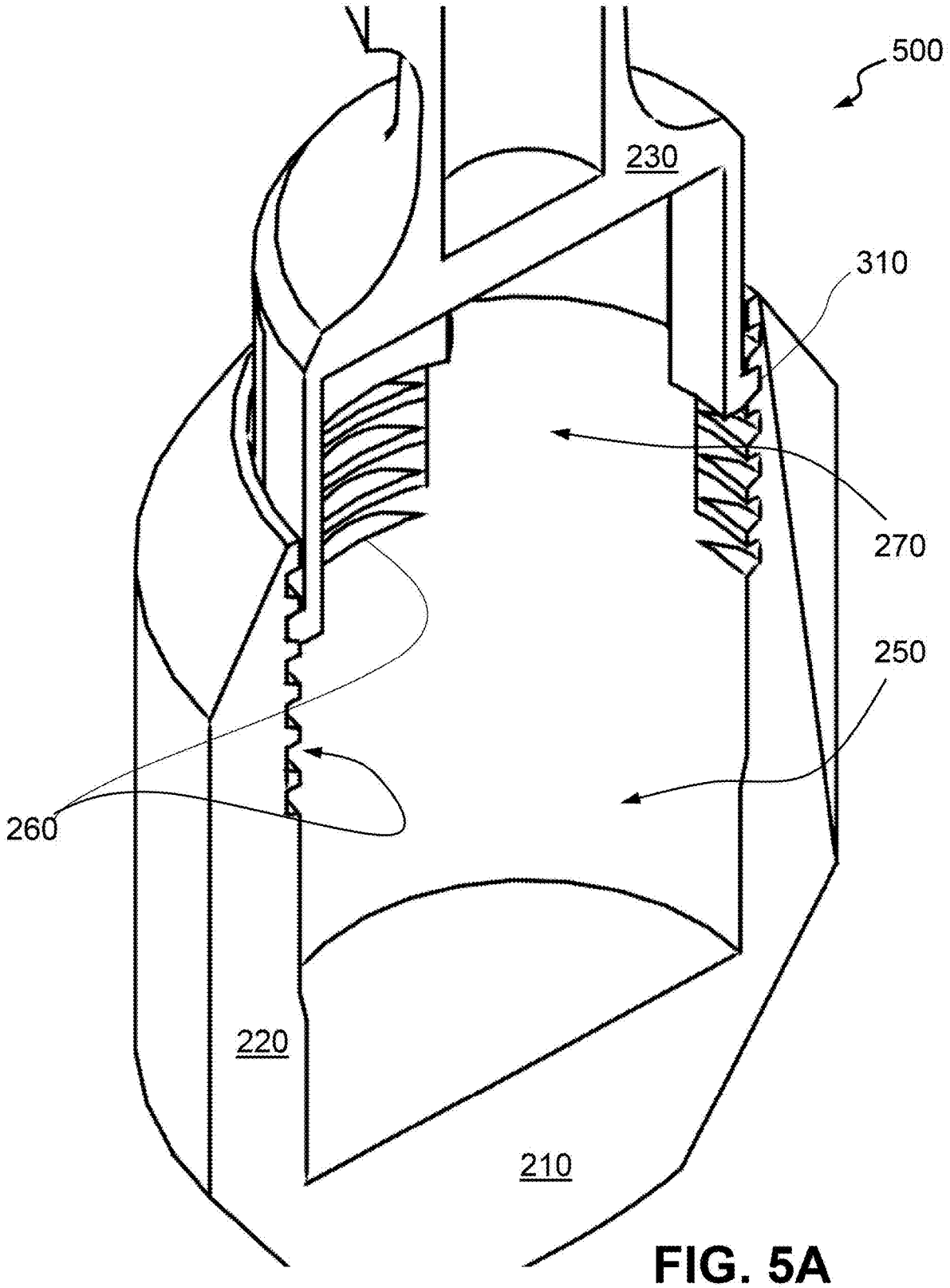
FIGS. 5A and 5B are isometric detail views of the assembly.
Figure 5B:
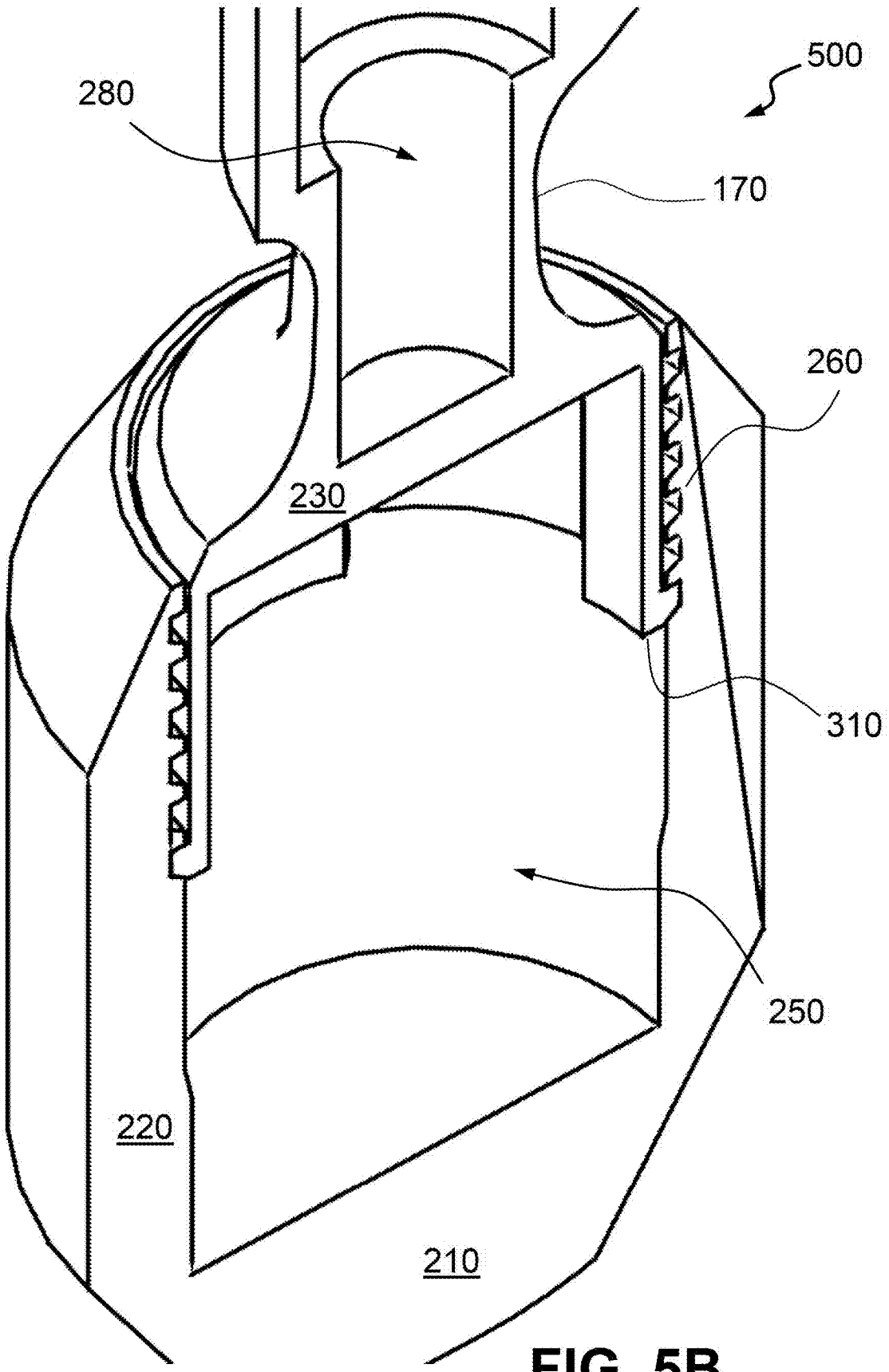

FIGS. 5A and 5B show isometric cutaway views 500 of the exemplary assembly 110, with both front and rear sections 120 and 130 in axial cross-section. FIG. 5A presents the assembly 110 in the collapsed configuration, while FIG. 5B features the assembly 110 at nearly the extended configuration, thereby presenting the auxiliary chamber 270 to extend payload volume from only the primary chamber 250.

Exemplary embodiments provide two primary components: a nose cone as the forward portion 120 and an aft tail as the rear portion 130. Each portion component can be produced as a single-piece unit using either injected plastic or 3D printer technology. The forward portion 120 is formed as a single-piece component featuring an internal cylindrical tube as the tube 220 with four sets of ratcheting inverted teeth 320 formed by the indentations 260. These teeth 320 are integrally formed during the manufacturing process, whether by molding or printing. The rear portion 130 also constitutes a single-piece component, equipped with four fingers or flanges 165 each having beveled tabs on the bottom and sides. These tabs 310 facilitate smooth insertion of the insert 150 into the tube 220.

Operational attachment: The rear portion 130 pushes into the front portion 120. In particular, the beveled tabs 310 guide the insert 250 into the tube 220, where they align with the ratcheting teeth 320 formed by the indentations 260. Further pushing causes the tabs 310 to engage with the indentations 260, locking the rear portion 130 securely in position on the front portion 120.

Interactive locking: Friction between the beveled tabs 310 and the ratcheting indentations 260 secures the rear portion 130 to the front portion 120. The exemplary design of the assembly 110 prevents the rear portion 130 from translating axially backward without disengaging the indentations 260, thereby avoiding accidental disconnection.

Detachment: The rear portion 130 must be twisted to disengage the ratcheting indentations 260 for withdrawal from the front portion 120 to remove the rear portion 130. Upon disengagement of tabs 310 from their corresponding indentations 260, the flanges 165 and the sleeve 160 can slide out of the tube 220.

Exemplary embodiments enable rapid and effortless reconfiguration of packages through its integrated design, hence eliminating the need for fasteners. The ratcheting teeth mechanism, combined with beveled tabs, ensures a secure and reliable connection that minimizes the risk of accidental disconnection. Utilizing injected plastic or 3D printing technology simplifies manufacturing and reduces costs by eliminating separate mechanical fasteners. The design flexibility of the assembly 110 accommodates different sizes of payloads, with the ratcheting teeth 320 enabling the rear portion 130 to be adjusted until the payload snugly fits within the payload volume comprising cavities 250 and optionally 270.

The incorporation of beveled tabs 310 and integrated ratcheting teeth 320 within a single component facilitates ease of assembly and enhances the reliability of the connection. The exemplary design ensures that once the rear portion 130 locks in place, retraction is precluded without disengaging the locking mechanism by deliberate twist, thus preventing unintentional disconnections.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A modular air-drop package assembly for delivering an internal payload, said assembly oriented along axial, radial and angular directions, and comprising:

a front section with a hollow housing open at a rear end of said front section along the axial direction, said housing having an inner wall that include a plurality of angularly spaced indentations, each indentation extending radially into said wall; and a rear section having a bulkhead that closes said housing at said rear end of said front section, a sleeve that extends axially forward from said bulkhead along the axial direction for insertion into said housing, and a corresponding plurality of flanges that extend forward from said bulkhead, each flange having a radially extending tab that engages with a corresponding indentation of said plurality of indentations.

2. The assembly according to claim 1, wherein said front and rear sections are axi-symmetric.

3. The assembly according to claim 1, wherein said plurality of indentations and said corresponding plurality of flanges is four each.

4. The assembly according to claim 1, wherein said front and rear sections are composed of at least one of acrylonitrile butadiene styrene, polyethylene terephthalate, nylon, and polystyrene.

5. The assembly according to claim 1, wherein said front and rear sections are composed of acrylonitrile butadiene styrene.

6. The assembly according to claim 1, wherein said rear section detaches from said front section by angular twist to release said corresponding plurality of flanges away from said plurality of indentations.

7. The assembly according to claim 6, wherein each said flange includes a tab that engages a corresponding indention, said tab having a bevel that protrudes radially increasing towards a peak between edges of said flange, and a forward edge with chamfer.

8. The assembly according to claim 1, wherein said rear section further includes a tail with an auxiliary plurality of stabilization fins.

9. The assembly according to claim 1, further including a supplemental plurality of indentations axially forward and parallel to said plurality of indentations.

10. A modular air-drop package assembly for delivering an internal payload, said assembly oriented along axial, radial and angular directions, and comprising:

a front section with a hollow housing open at a rear end along the axial direction, said housing having an inner wall that include a first plurality of axially distributed sets of a second plurality of angularly spaced indentations, each indentation extending radially into said wall; and a rear section having a bulkhead that closes said housing at said rear end of said front section, a sleeve that extends axially forward from said bulkhead along the axial direction for insertion into said housing, and a third plurality of flanges that-extend forward from said bulkhead, said third plurality being equal to said second plurality, each flange having a radially extending tab that engages with a single indentation of said sets of indentations.

11. The assembly according to claim 10, wherein said second plurality of indentations and said third plurality of flanges is four each.

12. The assembly according to claim 10, wherein said front and rear sections are axi-symmetric.

13. The assembly according to claim 10, wherein said front and rear sections are composed of at least one of acrylonitrile butadiene styrene, polyethylene terephthalate, nylon, and polystyrene.

14. The assembly according to claim 10, wherein said front and rear sections are composed of acrylonitrile butadiene styrene.

15. The assembly according to claim 10, wherein said rear section detaches from said front section by angular twist to release said corresponding plurality of flanges away from said plurality of indentations.

16. The assembly according to claim 15, wherein each said flange includes a tab that engages a corresponding indention, said tab having a bevel that protrudes radially increasing towards a peak between edges of said flange, and a forward edge with chamfer.

17. The assembly according to claim 10, wherein said rear section further includes a tail with a fourth plurality of stabilization fins.

18. The assembly according to claim 1, wherein said front section includes a closed nose at a front end axially opposite said rear end.

19. The assembly according to claim 10, wherein said front section includes a closed nose at a front end axially opposite said rear end.

* * * * *